US008862030B2

(12) United States Patent
Lee et al.

(10) Patent No.: US 8,862,030 B2
(45) Date of Patent: Oct. 14, 2014

(54) DRIVING ASSEMBLY FOR PHOTOSENSITIVE DRUM, PHOTOSENSITIVE DRUM ASSEMBLY, PROCESS CARTRIDGE, AND IMAGE FORMING APPARATUS

(75) Inventors: Bum Jin Lee, Cheongju-si (KR); Chang Rae Seong, Cheongju-si (KR); Jang Soon Park, Seongnam-si (KR)

(73) Assignees: Baiksan OPC Co., Ltd., Jinchun-gun, Chungbuk (KR); Jang Soon Park, Seongnam-si, Gyeonggi-do (KR)

( * ) Notice: Subject to any disclaimer, the term of this patent is extended or adjusted under 35 U.S.C. 154(b) by 84 days.

(21) Appl. No.: 13/635,149

(22) PCT Filed: Apr. 13, 2012

(86) PCT No.: PCT/KR2012/002782

§ 371 (c)(1),
(2), (4) Date: Sep. 14, 2012

(87) PCT Pub. No.: WO2012/141509

PCT Pub. Date: Oct. 18, 2012

(65) Prior Publication Data

US 2013/0058681 A1 Mar. 7, 2013

(30) Foreign Application Priority Data

Apr. 15, 2011 (KR) ..... 10-2011-0034930

(51) Int. Cl.
*G03G 15/00* (2006.01)

(52) U.S. Cl.
CPC ..... *G03G 15/757* (2013.01)
USPC ..... 399/167

(58) Field of Classification Search
USPC ..... 399/111, 167
See application file for complete search history.

(56) References Cited

U.S. PATENT DOCUMENTS

| | | | | |
|---|---|---|---|---|
| 6,006,058 | A | 12/1999 | Watanabe et al. | 399/167 |
| 6,029,032 | A | 2/2000 | Watanabe et al. | 399/111 |
| 6,169,866 | B1 | 1/2001 | Watanabe et al. | 399/111 |
| 6,324,363 | B1 | 11/2001 | Watanabe et al. | 399/111 |
| 6,330,409 | B1 | 12/2001 | Watanabe et al. | 399/111 |
| 6,336,018 | B1 | 1/2002 | Kawai et al. | 399/117 |
| 6,892,042 | B2 | 5/2005 | Jang et al. | 399/167 |
| 2008/0152388 | A1 | 6/2008 | Ueno et al. | 399/167 |

FOREIGN PATENT DOCUMENTS

| | | | |
|---|---|---|---|
| JP | 10-153942 | 6/1998 | G03G 21/18 |
| JP | 2001-324909 | 11/2001 | G03G 21/18 |
| KR | 10-2003-0026641 | 4/2003 | G03G 15/00 |
| WO | WO 2008/078836 | 7/2008 | G03G 21/18 |

OTHER PUBLICATIONS

International Search Report (dated Oct. 30, 2012) issued in connection with corresponding International Application No. PCT/KR2012/002782.

*Primary Examiner* — G. M. Hyder
(74) *Attorney, Agent, or Firm* — Kusner & Jaffe

(57) ABSTRACT

Provided is a photosensitive drum driving assembly, a photosensitive drum assembly, a process cartridge, and an image forming apparatus. The driving assembly including a supporting body and an engaging protrusion is connected to a drive shaft having a triangular twisted hole to transfer a rotary driving force from an image forming apparatus. The engaging protrusion twistedly protrudes to be inserted into the twisted hole, and includes three or more line contact portions on its cross-section perpendicular to the protrusion direction. The line contact portions are in line-contact with the surface of the twisted hole, and at least one portion of a surface formed by continuously joining the line-contact portions along the protrusion direction is a twisted contact-surface to receive the rotary driving force transferred by the drive shaft.

14 Claims, 33 Drawing Sheets

DRIVING ASSEMBLY FOR PHOTOSENSITIVE DRUM, PHOTOSENSITIVE DRUM ASSEMBLY, PROCESS CARTRIDGE, AND IMAGE FORMING APPARATUS

CROSS-REFERENCE TO RELATED APPLICATIONS

This application is a national stage application based on International Application No. PCT/KR2012/002782, filed on Apr. 13, 2012, which claims priority to Korean Patent Application No. 10-2011-0034930, filed on Apr. 15, 2011, the contents of both of which are incorporated herein by reference.

BACKGROUND OF THE INVENTION

The present invention disclosed herein relates to a photosensitive drum driving assembly for receiving a driving force provided from a main body of an image forming apparatus, a photosensitive drum assembly, a process cartridge, and the image forming apparatus, and more particularly, to a photosensitive drum driving assembly and a photosensitive drum assembly, a process cartridge, and an image forming apparatus, which can rotate a photosensitive drum while minimizing a loss of a driving force provided from a main body of an image forming apparatus and can ensure a reliable and longer lifespan.

Generally, examples of image forming apparatuses, which print characters or images on recording materials such as paper, include copy machines, laser printers, LED printers, and facsimiles.

An image forming apparatus includes a toner and a cartridge that records characters and images on recording materials such as paper. The cartridge is detachably provided for replacement of the toner.

FIG. 1 is a schematic view illustrating the configuration of a typical image forming apparatus. FIG. 2 is a perspective view illustrating the exterior of a cartridge of FIG. 1. FIG. 3 is a cross-sectional view illustrating a photosensitive drum of the cartridge of FIG. 1 and a peripheral configuration thereof.

Referring to FIGS. 1 through 3, the image forming apparatus includes a process cartridge that stores a toner and supplies the toner to a recording material. The image forming apparatus feeds the recording material 88 such as paper in a direction 88*s* while rotating a plurality of rollers 73, 74, 75, 76 and 77 disposed in a main body 1. Simultaneously, the image forming apparatus delivers data such as images to the process cartridge 2, and transcribes the toner stored in a toner storage 28 on the recording material as necessary through a photosensitive drum 10 to print a desired image on the recording material 88.

For this, the process cartridge 2 includes a photosensitive drum 10, a cleaning unit, a writing unit, and a developing unit. Electric charges that reach the photosensitive drum 10 cause photosensitivity. After the toner is electrodeposited on a sensitized portion, the toner is moved onto a paper, and then heat is applied to fix an image on the paper.

The process cartridge 2 is provided detachably from the main body 1. When the process cartridge is mounted, a driving assembly 20 coupled to the photosensitive drum 10 is coupled to a driving force providing apparatus provided in the main body 1 to receive a rotary driving force. Specifically, a protrusion 21*p* for receiving a rotary force is protrusively formed at the end portion of the driving assembly to be coupled to components provided in the main body 1.

The reference numeral 49 unexplained denotes a case for supporting the rotation of the photosensitive drum 10 of the process cartridge 2, and the reference numeral 30*g* unexplained denotes a gear that is disposed at a side opposite to the driving assembly 20 and transfers a rotary force. Also, the reference numeral 29 unexplained denotes a support that is protrusively formed on the driving assembly 20, and the reference numeral 23*g* unexplained denotes a gear that is disposed on the outer circumferential surface of the driving assembly 20.

FIGS. 4 and 5 are perspective views illustrating a rotation driving force transmission structure of a typical image forming apparatus. Specifically, FIGS. 4 *and* 5 illustrate a rotary driving force transmission structure of an image forming apparatus disclosed in Korean Patent No. 258609, which transfers a driving force by the method described above.

Referring to FIGS. 4 and 5, when a process cartridge 2 is inserted into a main body of an image forming apparatus, a twisted protrusion 21*p* of a driving assembly 20 coupled to one side of a photosensitive drum 10 provided in the process cartridge 2 is inserted into a twisted hole 181 of a drive shaft 180 provided in the main body 1. As the drive shaft 180 is rotated by a driving motor provided in the main body 1 of the image forming apparatus, the twisted hole 181 of the drive shaft 180 and the twisted protrusion 210 are coupled to each other to be rotated. Thus, a driving force provided from the driving motor is transferred to the photosensitive drum 10 to allow the photosensitive drum 10 to rotate.

In this case, the twisted protrusion 21*p* is in point contact with the inner surface of the twisted hole 181 at three portions when viewing the section of the twisted protrusion 21*p*. As a whole, a driving force is transferred through line contact at the three portions.

The drive shaft 180 includes a gear part 182*g* for receiving a driving force from the driving motor.

However, there is the following limitation in the typical technology described above.

Since a driving force is transferred by a point contact based on the section, a stress is concentrated on a small contact point, increasing the abrasion speed. Accordingly, the contact point is easily abraded or damaged, making it difficult to achieve exact performance during the expected lifespan. Specifically, regarding the characteristics of Korean Patent No. 258609, the twisted protrusion 21*p* contacts the inner surface of the twisted hole 181 when a driving force is being transferred, and is spaced from the inner surface of the twisted hole 181 when a driving force is not being transferred. Thus, the point contact portion, i.e., the angular point portion of the twisted protrusion 21*p* is inevitably and continuously exposed to a certain level of repeated shock and friction. Particularly, since printing is performed several thousand times until the cartridge is replaced, loads such as shock or friction applied to the twisted protrusion 21*p* may reach a considerable level. Due to such repetitive load, the point contact portion of the twisted protrusion 21*p* may be easily abraded or damaged. Furthermore, when the twisted protrusion 21*p* rotates while being inserted into the twisted hole 181, the twisted protrusion 21*p* becomes in point contact with the twisted hole 181. Accordingly, it is unstable for the twisted protrusion 21*p* to be seated on a location where the rotary driving force is exactly transferred.

When the point contact portion of the twisted protrusion 21*p* is abraded or damaged, the rotation precision is reduced upon rotation of the photosensitive drum, making it difficult to maintaining the concentricity of the drive shaft 180 and the photosensitive drum 10. In other words, the photosensitive drum 10 may vibrate during its rotation, and may affect the image quality of the image forming apparatus 1.

SUMMARY OF THE INVENTION

The present invention provides a photosensitive drum driving assembly, a photosensitive drum assembly, a process cartridge, and an image forming apparatus, which allows a protrusion receiving a driving force from a main body of the image forming apparatus not to be easily abraded or damage.

The present invention also provides a photosensitive drum driving assembly, a photosensitive drum assembly, a process cartridge, and an image forming apparatus, which stably receives a driving force from a main body of the image forming apparatus to allow the image forming apparatus to maintain a stable image quality.

The present invention also provides a photosensitive drum driving assembly, a photosensitive drum assembly, a process cartridge, and an image forming apparatus, which enables smooth transmission of a driving force when the process cartridge is inserted into the image forming apparatus by easily inserting an engaging protrusion of the photosensitive drum assembly into a triangular twisted hole formed in a main body of the image forming apparatus.

Embodiments of the present invention provide driving assembly for a photosensitive drum, connected to a drive shaft having a triangular twisted hole to transfer a rotary driving force from an image forming apparatus, the driving assembly including: a supporting body combined at one side of the photosensitive drum; and an engaging protrusion twistedly protruding from the supporting body and inserted into the twisted hole, wherein the engaging protrusion having three or more line contact portions on its cross-section perpendicular to the protrusion direction, the line contact portions being in line contact with a twisted surface of the twisted hole, and wherein at least one portion of a surface formed by continuously joining the line contact portions along the protrusion direction is a twisted contact surface that is in surface contact with the twisted surface of the twisted hole to receive the rotary driving force transferred by the drive shaft.

In some embodiments, the engaging protrusion may be formed to have a uniform section from a front end portion to a base portion thereof.

In other embodiments, the twisted contact surface may include a contact expansion region in which a length of the line contact portion gradually increases as getting closer to a base portion from a front end portion.

In still other embodiments, the engaging protrusion may be averagely spaced from the twisted hole by about 0.4 mm to about 0.6 mm at the front end portion thereof.

In even other embodiments, the engaging protrusion may form the contact expansion region such that a section near an angular point corresponding to an angular point of the twisted hole protrudes more outwardly from a rotation center at the base portion than a section at the front end portion.

In yet other embodiments, the engaging protrusion may have an inclination surface formed by cutting a front end portion thereof such that the twisted contact surface becomes smaller at the front end portion of the engaging protrusion.

In further embodiments, the line contact portion may not be formed at a front end portion of the engaging protrusion.

In still further embodiments, the inclination surface may have an inflection portion at which an inclination degree changes according to the protrusion direction of the engaging protrusion.

In even further embodiments, the engaging protrusion may have a protrusion portion protruding in a direction perpendicular to the protrusion direction, and the twisted contact surface may be located at the protrusion portion.

In yet further embodiments, wherein the twisted hole may be formed in a twisted type along a depth direction such that a triangular section and a circular section are combined, and the line contact portion of the engaging protrusion in line contact with the twisted surface of the twisted hole may include a region that contacts the circular section.

In much further embodiments, the engaging protrusion may twistedly protrude from the supporting body so as to have a shape divided into three protrusions including the line contact portion, respectively.

In other embodiments of the present invention, photosensitive drum assemblies including: a photosensitive drum; and a driving assembly according to any one of claims 1 to 9, coupled to one end portion of the photosensitive drum and receiving a driving force provided from a driving motor mounted in a main body of an image forming apparatus.

In still other embodiments of the present invention, process cartridges detachably coupled to a main body of an image forming apparatus, including: a photosensitive drum assembly according to claim 12 printing an image on a recording material; and a toner storage supplying a toner to the photosensitive drum.

In even other embodiments of the present invention, image forming apparatuses including: a main body; a driving motor mounted in the main body; a drive shaft transferring a driving force provided from the driving motor and having a triangular twisted hole; and a process cartridge according to claim 13, detachably coupled to the main body and receiving the driving force from the drive shaft.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
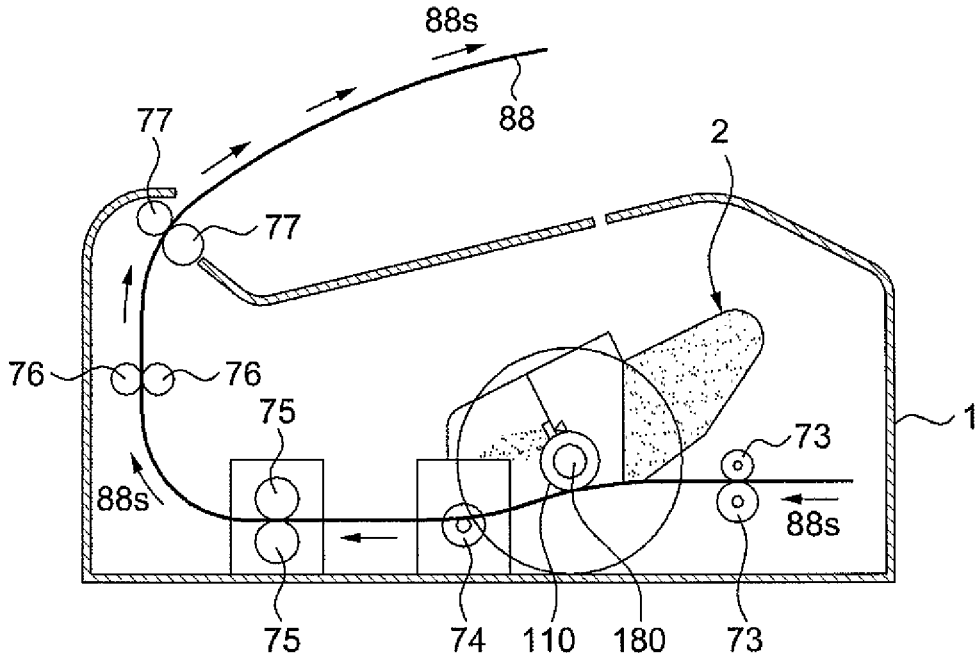
FIG. 1 is a schematic view illustrating the configuration of a typical image forming apparatus.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

Referring to FIGS. 6 through 10B, a photosensitive drum assembly 100 according to a first embodiment of the present invention may include a photosensitive drum 110 and a driving assembly 120 disposed on the photosensitive combination 120, and may be coupled to a drive shaft 180 rotating in a main body 1 of an image forming apparatus to receive a rotary force.

The driving assembly 120 may include a supporting body 122 combined at one side of the photosensitive drum 110, an engaging protrusion 121 protruding from the supporting body 122 so as to have a certain section and inserted into a triangular twisted hole 181, and a gear part 123 receiving a rotary driving force from the drive shaft 180 to rotate and delivering the rotary force to a development unit.

Specifically, a twisted contact surface S may be provided on the engaging protrusion 121 inserted into and engaging with the triangular twisted hole 181 to be in surface contact with on a twisted surface 181 s the triangular twisted hole 181. While the twisted contact surface S of the engaging protrusion 121 and the twisted surface 181*s* of the triangular twisted hole 181 are in surface contact 121*s*1 with each other at three points, the rotary driving force may be delivered from the drive shaft 180 to the photosensitive drum 110.

In this case, the triangular twisted hole 181 may be formed to have a depth d of about 3.5 mm to about 5.0 mm from a section Y1, Y2 and Y3 at an inlet side to a section Z1, Z3 and Z3 at a bottom side thereof. A twisted angle θ0 may range from about 30° to about 35°, but embodiments are not limited to the numerical range.

The engaging protrusion 121 may protrude from the supporting body 122 in a twisted shape such that a section including a line contact portion 121*s* rotates by a certain twisted angle θ1 upwardly from a base part to a front end part E.

Specifically, the second of the engaging protrusion 121 may have three ling contact parts 121 s forming a twisted contact surface S. Each of line contact portions 121*s* may be formed on protrusions 121*p* having an angle of about 120°. However, the method of forming the line contact portion 121*s* and the shape of the engaging protrusion 121 are merely examples, and the scope of the present invention is not limited thereto. For example, the engaging protrusion 121 may be in surface contact with the twisted surface 181*s* of the triangular twisted hole 181, and the sectional shape of the engaging protrusion 121 may be modified by those skilled in the art within the scope of the present invention, similarly to other embodiments described later.

Figure 9A:
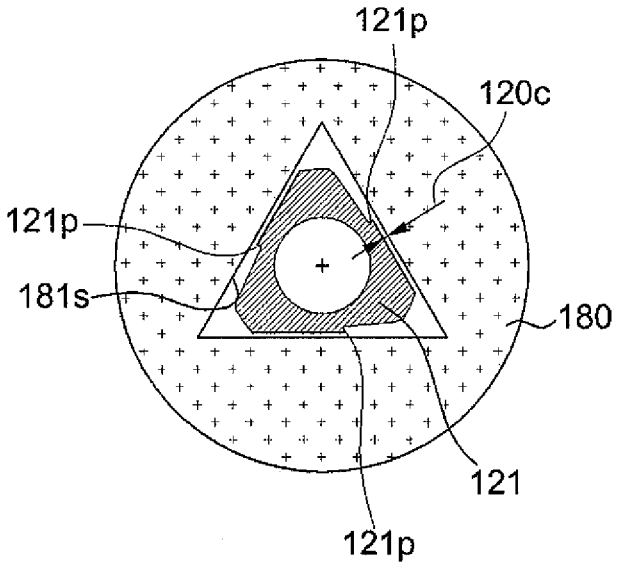
FIG. 9A is a cross-sectional view illustrating the rotation driving force transmission structure of FIG. 6 when viewed from a base part to a front end part of a twisted protrusion while an engaging protrusion is spaced from a triangular twisted hole by a certain interval.
Figure 9B:
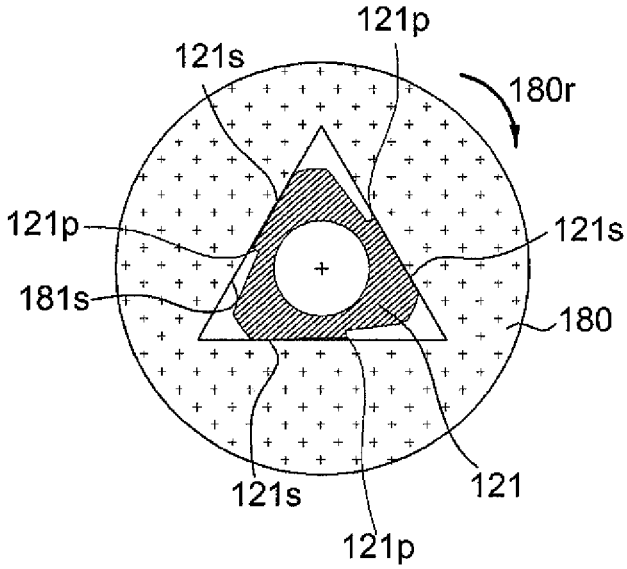
FIG. 9B is a cross-sectional view illustrating the rotation driving force transmission structure of FIG. 6 when viewed from a base part to a heat part of a twisted protrusion while an engaging protrusion is engaging with a triangular twisted hole.
Figure 9C:
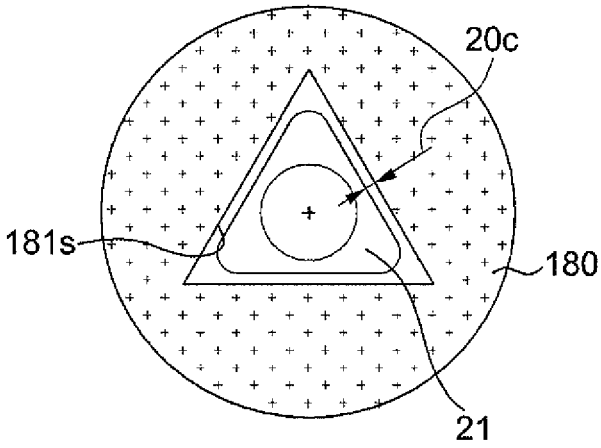
FIG. 9C is a cross-sectional view illustrating a typical rotation driving force transmission structure when viewed from a base part to a heat part of a twisted protrusion while an engaging protrusion is engaging with a triangular twisted hole.

The twisted contact surface S may be formed to include surfaces that are formed by continuously connecting the ling contact parts 121*s*, in surface contact with a portion of the twisted surface 181*s* of the twisted hole 181 to deliver a rotary driving force. The engaging protrusion 121 may twistedly protrude from the supporting body 122 so as to have a certain section. Thus, as shown in FIG. 9A, an interval 120*c* between the twisted contact surface S of the engaging protrusion 121 and the twisted hole may be uniform along the whole protrusion height. In other words, the interval 120*c* between the twisted contact surface S of the engaging protrusion 121 and the twisted hole 181 may become about 0.4 mm to about 0.6 mm, which is an interval between a typical triangular protrusion 21 and the typical twisted hole 181 as shown in FIG. 9C. Also, as shown in FIG. 9B, when the drive shape 180 rotates (180*r*), the section of the twisted contact surface S of the engaging protrusion 121 may form a line contact portion 121*s* with the surface 181*s* of the twisted hole 181.

Figure 17A:
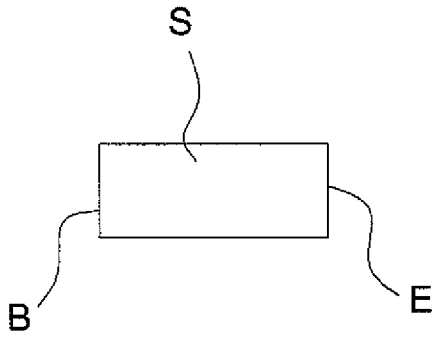
FIGS. 17A through 17E are views illustrating shapes of twisted contact surfaces of engaging protrusions according to first to third embodiments of the present invention.

As shown in FIG. 17A, the driving assembly 100 according to the first embodiment of the present invention may have a twisted contact surface S of a rectangular shape from a base B to a front end E. Thus, since the twisted hole 181 of the image forming apparatus and the engaging protrusion 121 of the driving assembly 120 are adhered closely to each other by a high frictional force, a sliding therebetween may be inhibited, thereby exactly delivering a rotary driving force from the image forming apparatus without a loss.

Figure 7:
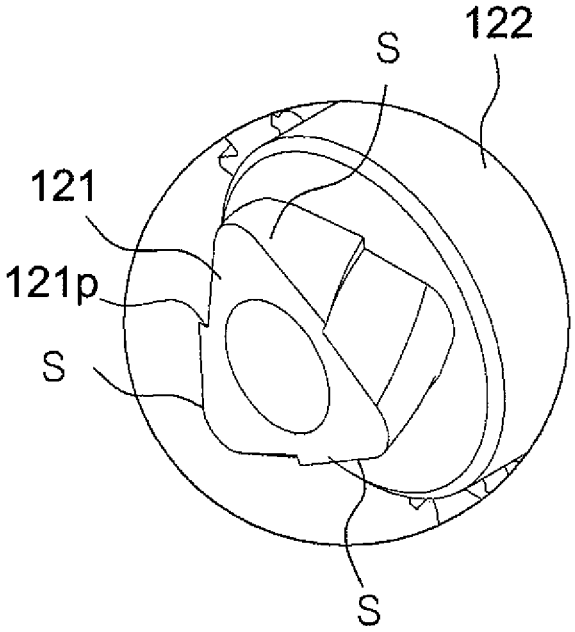
FIG. 7 is a magnified view of a portion '1X' of FIG. 6
Figure 8:
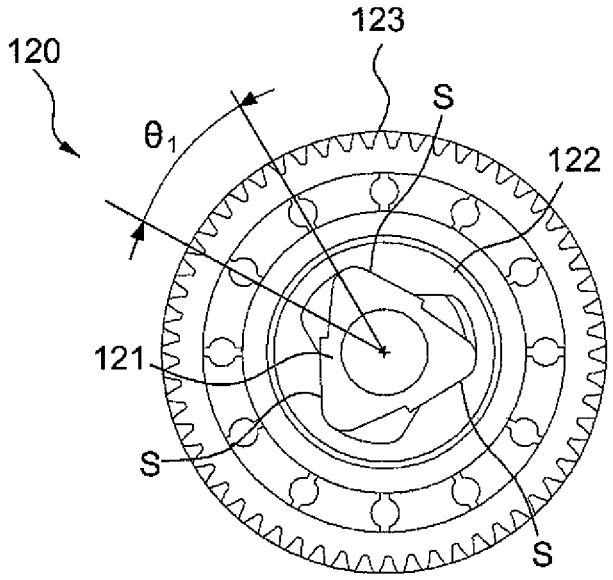
FIG. 8 is a front view of FIG. 7.

The twisted contact surface S may be formed on the engaging protrusion 121 in various forms. As shown in FIG. 7, a protrusion 121*p* may be formed on one surface near an angular point of the substantially triangular section in a direction perpendicular to the protrusion direction, defining a surface that is in surface contact with the twisted surface 181*s* of the twisted hole 181. Thus, since the protrusion 121*p* is provided on the side of the engaging protrusion 121, the durability of the engaging protrusion 121 can be improved, and the twisted contact surface S in surface contact can be formed even when there is a difference of the twist angle θ1 with the twisted surface 181*s* of the twisted hole 181.

In a rotary driving force transmission structure in a typical image forming apparatus, the section of the engaging protrusion 210 and the section of the triangular twisted hole 181 are in point contact with each other at three angular pointes of the engaging protrusion 21*p* to transfer a driving force. However, in the rotary driving force transmission structure of the image forming apparatus according the first embodiment of the present invention, as shown in FIG. 1A, the section of the engaging protrusion 121 and the section of the second of the triangular twisted hole 181 may be in line contact with each other at three portions, which forms a contact of a surface form (121*s*1) as a whole.

Figure 10A:
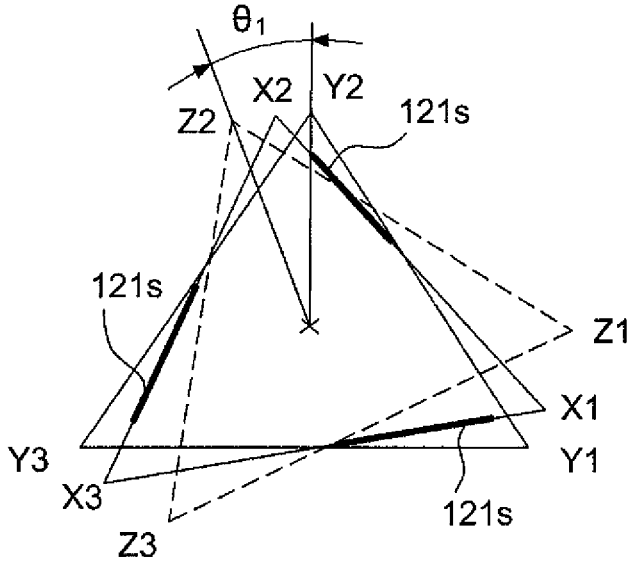
FIG. 10A is a view illustrating a contact area of an engaging protrusion of FIG. 8.
Figure 10B:
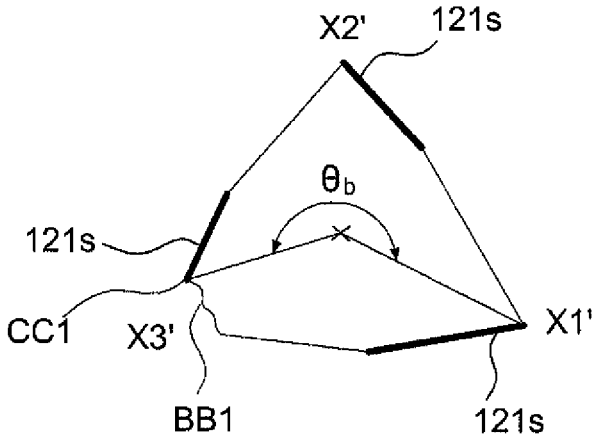
FIG. 10B is a view illustrating the engaging protrusion of FIG. 8 that is damaged at an edge of the contact area thereof.
Figure 10C:
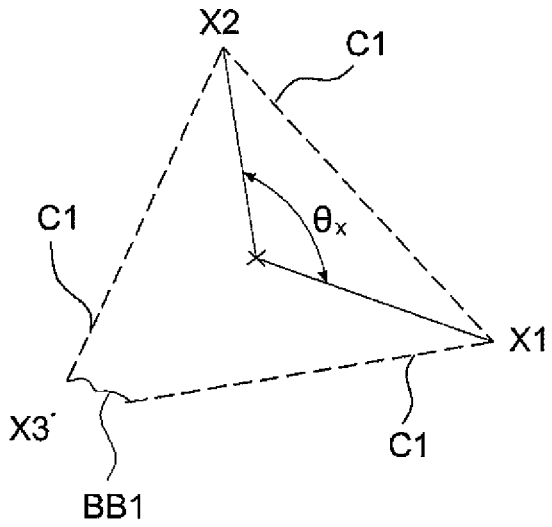
FIG. 10C is a view illustrating a typical engaging protrusion that is damage at an edge of a contact area thereof.

As shown in the configuration of a typical driving assembly of FIG. 10C, the section of the engaging protrusion is formed to have a triangular shape, and the engaging protrusion slides into the twisted hole 181 to transfer a rotary driving force while being in point contact with the twisted surface 181*s* of the twisted hole 181 at the angular pointes of the section. In such a typical configuration, since parts for transferring the rotary driving force are concentrated near the angular pointes, the stress may be severely concentrated, increasing the possibility of damage. Also, when damage BB1 occurs near the angular point of the engaging protrusion, the rotary driving force is transferred only by two angular pointes X1 and X2 that are not damaged. In this case, since an angle θx therebetween becomes equal to or smaller than about 180 degrees, the rotary driving force delivered from the image forming apparatus may be lost. Accordingly, when the damage BB1 occurs near the angular point in the typical driving assembly, the driving assembly may not rotate together with the twisted hole 181 in synchronization with the twisted hole 181, causing a significant reduction of the quality of the image output.

On the other hand, in the driving assembly 120 according to the embodiment of the present invention as shown in FIG. 10B, since the section of the engaging protrusion 121 forms the line contact portion 121*s* with the twisted surface 181*s* of the twisted hole 181, a substantially hexagonal section in which X1', X2' and X3' are connected may be formed. Accordingly, the engaging protrusion 121 and the twisted hole 181 may be in surface contact with each other and may show high frictional characteristics to transfer a rotary driving force. In this case, the line contact portion 121*s* may have a sufficient length that corresponds to about ⅙ to about ½ of one side of the engaging protrusion 121. Accordingly, a stress concentration phenomenon can be significantly reduced on the engaging protrusion 121. In addition, although the corner of the engaging protrusion 121 is damaged (BB1), as long as the whole length of the line contact portion 121 is not damaged, the ling contact portion 121*s* with a corner partially damaged (BB1) may be maintained in line contact with the twisted surface 181*s* of the twisted hole 181 at other regions of the line contact portion 121 s from the damaged location CC1. Accordingly, since the engaging protrusion 121 of the driving assembly 120 may transfer a rotary driving force via the line contact portion 121*s* near the three angular pointes X1', X2' and X3' including the angular point X3' that is damaged, an angle therebetween may be maintained at about 180 degrees or more. Thus, the loss of the rotary driving force transferred from the image forming apparatus can be fundamentally overcome. Accordingly, in the driving assembly 120, since the engaging protrusion 121 of the driving assembly rotates in synchronization with the twisted hole 181 even when damage occurs near the angular point of the engaging protrusion 121, the quality of the image output may not be reduced.

The features of the first embodiment described above may be applied to other embodiments described later.

On the other hand, the engaging protrusion 121 may be twisted at the same rotation ratio of section to length as the twisted hole 181. Here, the term "length" means the length of a protruding direction toward the rotation central shaft of the engaging protrusion 121 and the drive shaft 180. For example, when the twisted hole 181 has a depth of about 4 mm and a twisted angle θ1 of about 34 degrees, the rotation ratio of section to length of the twisted hole 181 may be about 8.5°/mm, and the engaging protrusion 121, particularly a portion thereof inserted into the twisted hole 181 may be twisted so as to have a rotation ratio of section to length of about 8.5°/mm. Thus, the whole of the twisted contact surface S of the engaging protrusion 121 inserted into the twisted hole 181 may become in surface contact with the twisted surface 181*s*, and a driving force can be more stably transferred. Also, since a pressure applied to each contact portion decreases due to the increase of the surface contact area, abrasion and damage can be more reliably prevented. The twisted surface area S of the engaging protrusion 121 may be formed by injection molding, or may be formed by partially cutting the engaging protrusion 121 after molding.

Thus, when the drive shaft 180 rotates, the twisted contact surface S of the engaging protrusion 121 of the driving assembly 120 may be adhered closely to the twisted surface 181*s* of the triangular twisted hole 181, and a rotary driving force may be transferred through the contact surface 121*s*1 on which the twisted contact surface S and the twisted surface 181*s* mutually contact each other to allow the driving assembly 120 to rotate in the same direction as the drive shaft. Thus, a rotary driving force may be more surely transferred from the driving shaft 180 to the driving assembly 120, and a local stress applied to the engaging protrusion 121 can be reduced.

Meanwhile, although it has been exemplified that the engaging protrusion 121 according to the first embodiment of the present invention is spaced from the twisted hole 181 by an interval 120*c* ranging from about 0.4 mm to about 0.6, the interval 120*c* between the engaging protrusion 121 and the twisted hole 181 of the driving assembly is not limited to the numerical range but can be modified into various dimensions.

Figure 11:
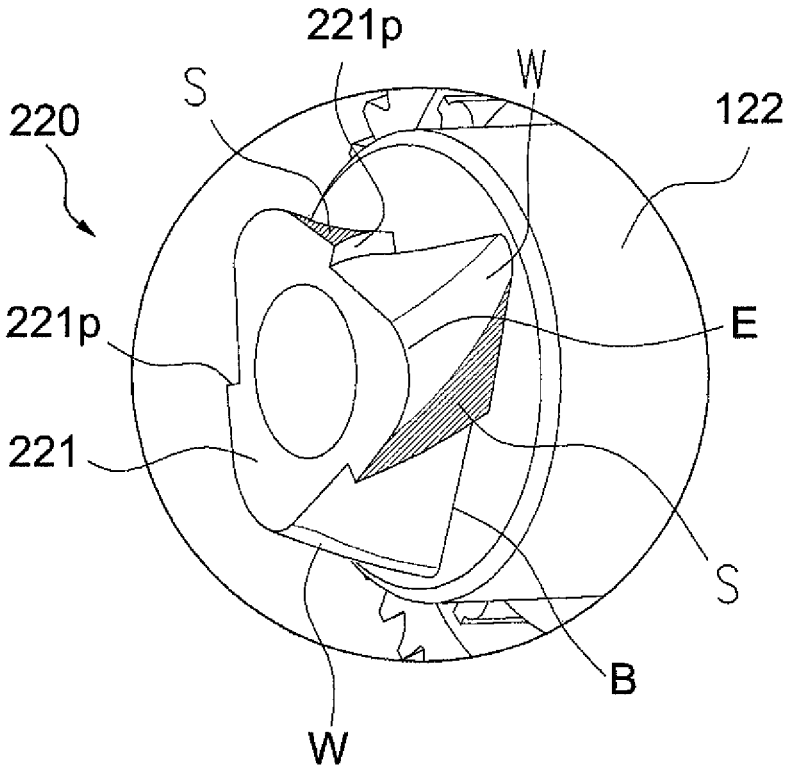
FIG. 11 is a perspective view illustrating a driving assembly according to a second embodiment of the present invention.
Figure 12A:
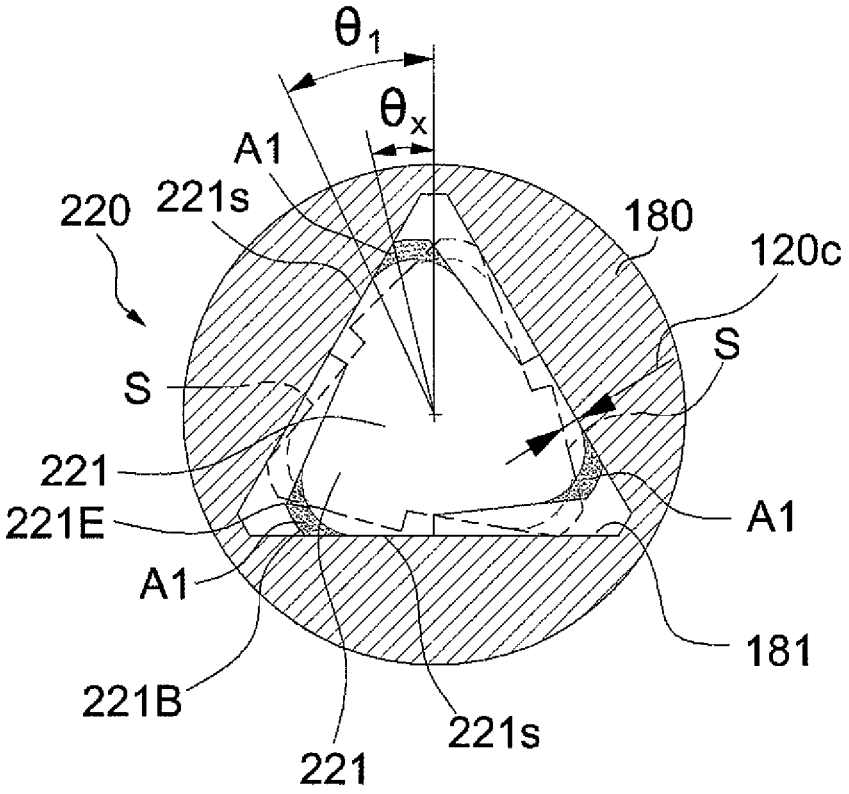
FIG. 12A is a view illustrating contact points with a triangular twisted hole when an insertion protrusion of the driving assembly of FIG. 6 is being rotated in the triangular twisted hole.
Figure 12B:
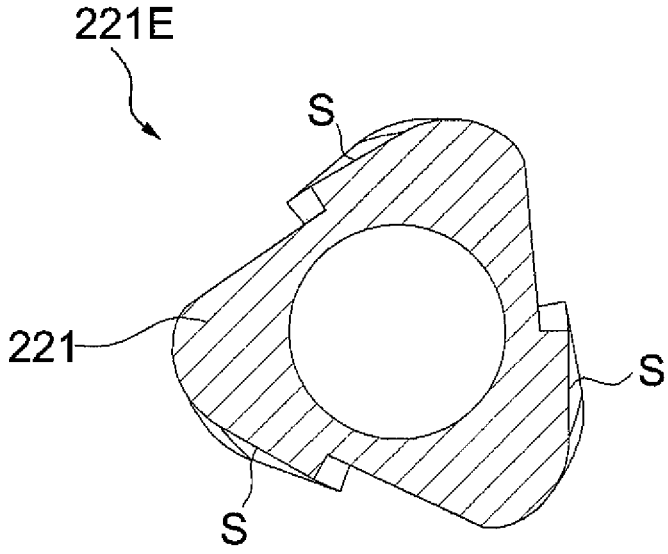
FIG. 12B is a cross-sectional view illustrating a front end part of an engaging protrusion of the driving assembly of FIG. 11 cut and viewed from the front end part thereof.
Figure 12C:
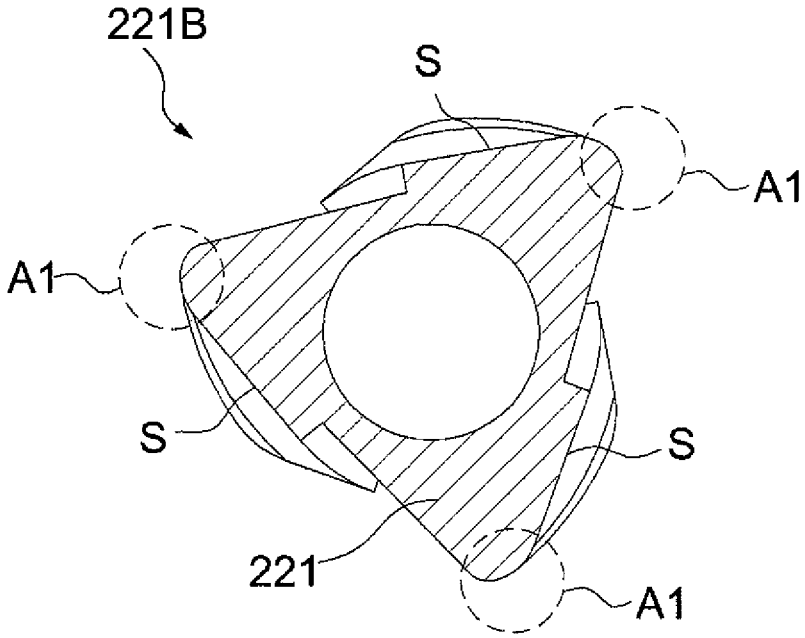
FIG. 12C is a cross-sectional view illustrating a base part of the engaging protrusion of the driving assembly of FIG, 11 cut and viewed toward the front end part thereof.
Figure 12D:
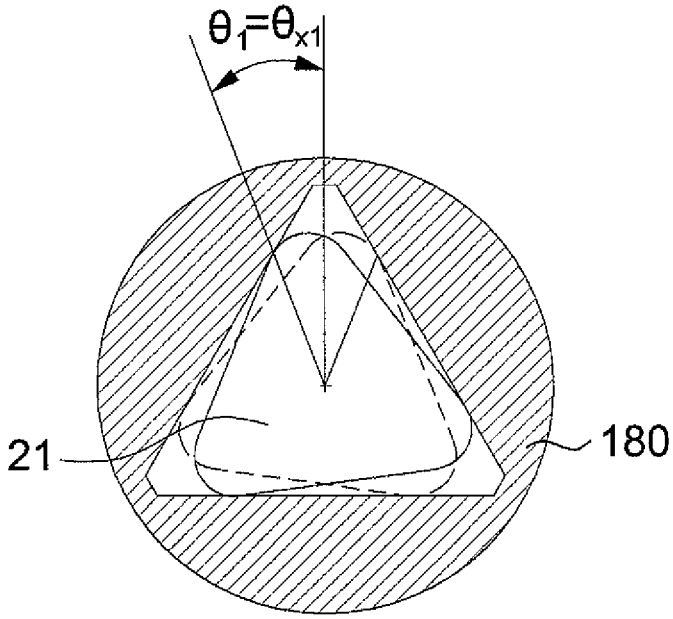
FIG. 12D is a cross-sectional view illustrating an engagement of a typical engaging protrusion and a triangular twisted hole when viewed from a base part to a front end part of a twisted protrusion.
Figure 13:
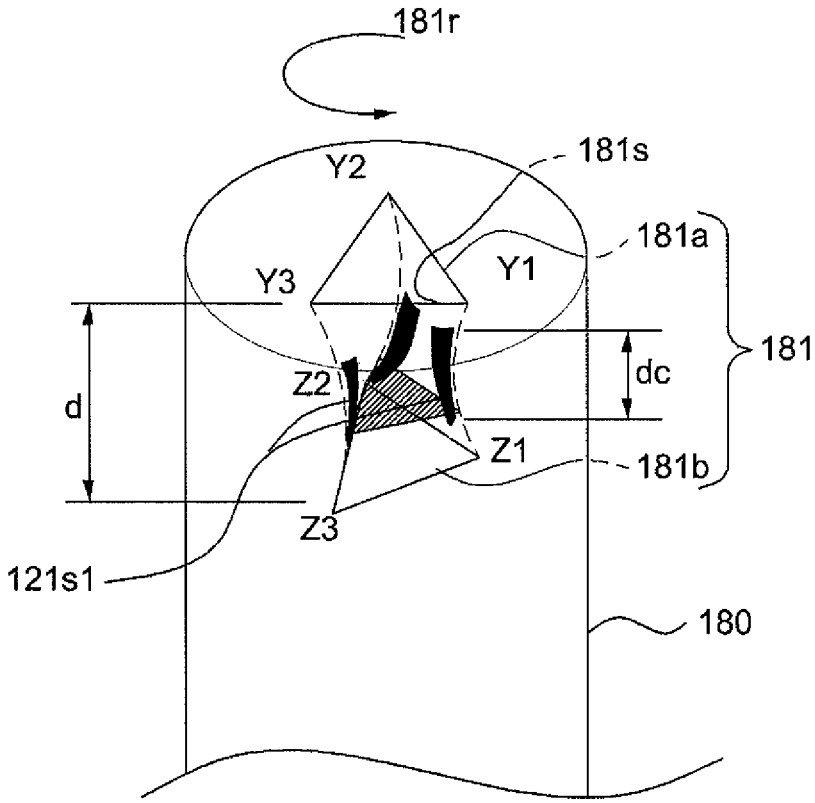
FIG. 13 is a cross-sectional view illustrating an engagement of an engaging protrusion and a triangular twisted hole of FIG. 11 when viewed from a base part to a front end part of a twisted protrusion.

Hereinafter, a second embodiment of the present invention will be described in detail with reference to FIGS. 11 through 13.

A photosensitive drum assembly 220 according to a second embodiment of the present invention differs from the first embodiment in that a contact expansion region dc in which the length of a line contact portion 221*s* with a twisted hole 181 become longer as getting closer to a base B from a front end E of an engaging protrusion 221 is formed. Accordingly, configurations of the second embodiment similar to those of the first embodiment will be indicated as the same or similar reference numerals, and detailed descriptions thereof will be omitted to clarify the essential points of the second embodiment.

The engaging protrusion 221 according to the second embodiment of the present invention will be described in detail below. A section 221E at the front end E of the engaging protrusion 221 may be similar to those of the front ends E of the first embodiment and previous engaging protrusion 121 and 21, but may have a difference in that a protrusion section Al gradually protrudes from the rotation center near the angular point of the engaging protrusion 221 corresponding to the angular point of a twisted hole 181 as getting closer to the base B from the front end B. In other words, an interval 120*c* between a twisted contact surface S and the twisted hole 181 at the section 221E of the front end E may be maintained within a range of about 0.4 mm to about 0.6 mm that is the interval 20*c* of the previous engaging protrusion 21, while a rotation angle θx may become smaller than the rotation angle θx1 of the previous engaging protrusion 21 as the protrusion section Al further outwardly protrudes at the base B. A reference numeral 221B unexplained denotes a section at the base B.

The shape of the engaging protrusion 221 may be verified by the protrusion section A1 that further protrudes from the rotation center to the outside of the radius at the section (see FIG. 12C) closer to the base B of the engaging protrusion 221 compared to the section (see FIG. 12B) closer to the front end E of the engaging protrusion 221.

Meanwhile, in the engaging protrusion 221 according to the second embodiment of the present invention, since the protrusion section A gradually protrudes outwardly from the rotation center near the angular point of the engaging protrusion 221, although the engaging protrusion (221 of FIG. 12A) according to the second embodiment is formed at the same twisted angle θ1 as the previous engaging protrusion (21 of FIG. 12D), the rotation angle θx rotatable in the same twisted hole 181 may become smaller than the rotation angle θx1 of the previous engaging protrusion 21. Thus, a contact expansion region dc may be formed while maintaining the section 221E of the front end E of the engaging protrusion 221 similarly to that of the previous one.

Figure 17B:
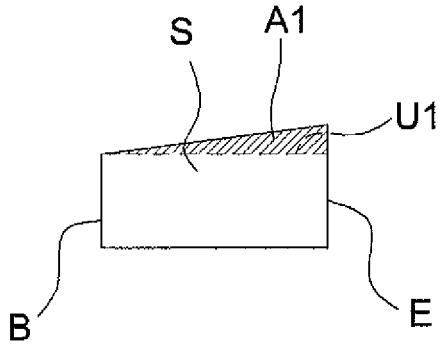

Accordingly, as getting closer to the base B of the engaging protrusion 221, the twisted contact surface S may gradually increase near the angular point by the protrusion section A1. Thus, a line contact portion 221*s* of the engaging protrusion 221 contacting the surface of the twisted hole 181 may gradually become longer at the base B. The contact surface S on which the engaging protrusion 221 contacts the twisted hole 181 may become a trapezoidal shape as shown in FIG. 17B, and the contact expansion region dc in which the length of the line contact portion 221*s* becomes longer as getting closer to the base part from the front end part may be formed.

The twisted contact surface (S of FIG. 17A) of the engaging protrusion 221 according to the second embodiment may have an area to which a wider contact area is added as getting closer to the base B by the protrusion section Al, while including all of the twisted contact surface (S of FIG. 17A) of the engaging protrusion 121 according to the first embodiment. The reference numeral U1 of FIG. 17B denotes a boundary of the twisted contact surface (S of FIG. 17A) at one side when a uniform section is formed along the protrusion direction (first embodiment) while maintaining the interval 120*c* of about 0.4 mm to about 0.6 mm with the twisted hole 181.

Thus, as the engaging protrusion 221 is more deeply inserted into the twisted hole 181, the base part of the protrusion 221 may more widely contact the surface 181*s* of the twisted hole 181, generating a larger friction to inhibit sliding of the engaging protrusion 221 and the twisted hole 181 as getting closer to the base part. Also, since a rotation driving force is transferred while achieving a higher rotation load capacity with a wider contact surface, the image quality of the image forming apparatus can be stably maintained. In addition, since the section 221E of the front end E of the engaging protrusion 221 according to the second embodiment maintains the same section as a front end of a typical engaging protrusion, a maximum section that can be smoothly inserted into the twisted hole 181 can be maintained, and can endure a strong force and shock, ensuring a longer durability.

Although it has been exemplified that the section 221E at the front end E of the engaging protrusion 221 according to the second embodiment maintains the interval 120*c* of about 0.4 mm to about 0.6 mm with the twisted hole 181, the interval between the twisted hole 181 and the section 221E at the front end E of the engaging protrusion 121 of the driving assembly is not limited to the numerical range described above but can be modified into various dimensions.

Figure 14:
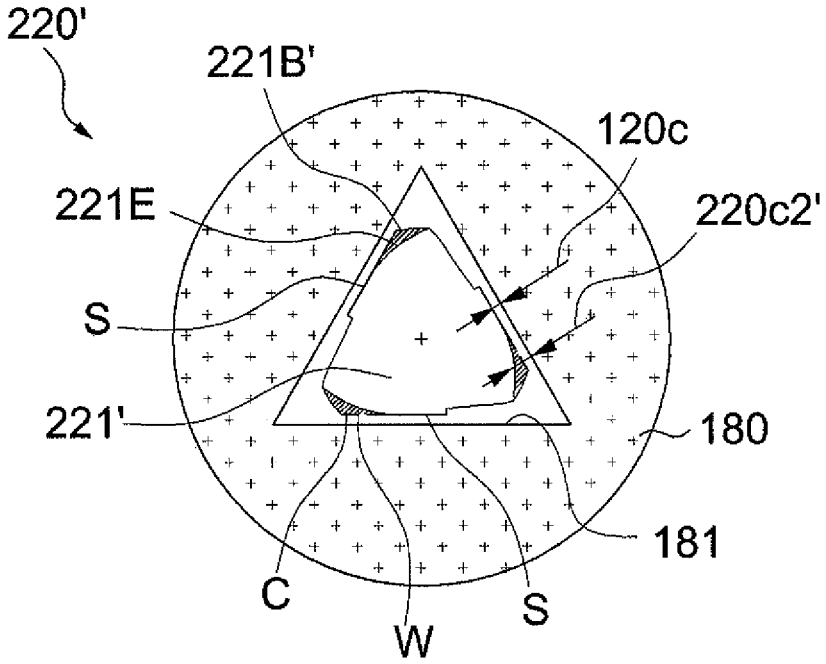
FIG. 14 is a cross-sectional view an engagement of an engaging protrusion and a triangular twisted hole when viewed from a base part to a front end part of a twisted protrusion according to another embodiment of the present invention.
Figure 15:
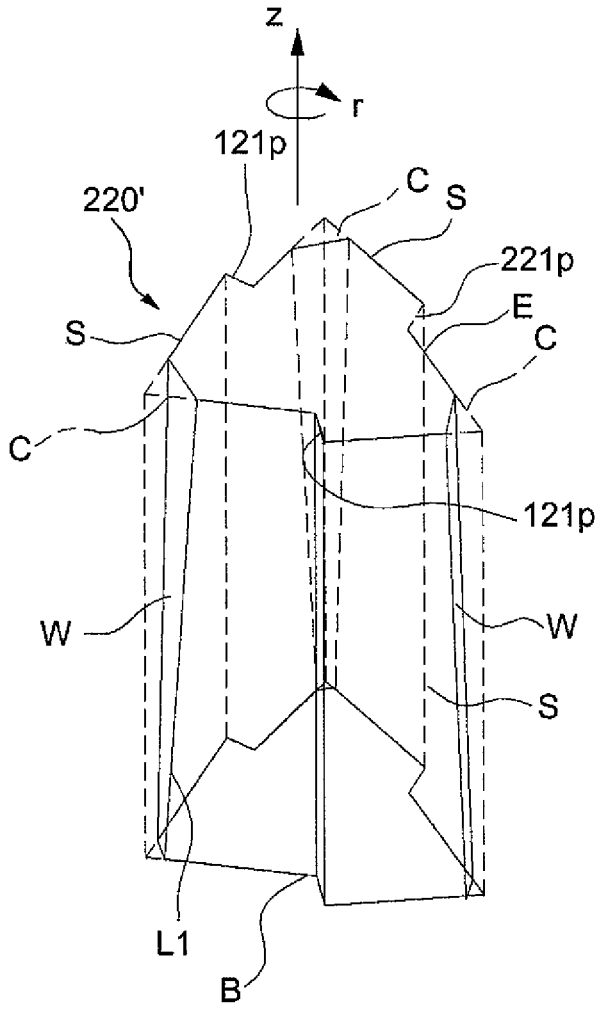
FIG. 15 is a perspective view illustrating a shape of the engaging protrusion of FIG. 14 before twisted.

In a modified example of the second embodiment, as shown in FIGS. 14 and 15, the engaging protrusion 221' may have a contact expansion region dc in which the length of the line contact portion 221*s* with the twisted hole 181 become longer as getting closer to the base B from the front end E. The contact expansion region dc may be formed by cutting a portion C that can be provided if a uniform section is formed along the protrusion direction of the engaging protrusion 221'.

The protrusion 220' of FIG. 15 illustrates a shape before twisting the engaging protrusion 221' of FIG. 14 along the protrusion direction z. As shown in FIG. 15, before the protrusion 220' is twisted in the direction r along the protrusion direction z, the twisted contact surface S contacting the twisted surface 181 s may be formed as a protrusion portion on the side surface of the triangular pillar. Also, an inclination surface W may be formed around the corner of the triangular section. The inclination surface W may cut a portion C of the twisted contact surface S such that the volume that is cut gradually decreases as getting closer to the base B from the front end E.

Figure 17C:
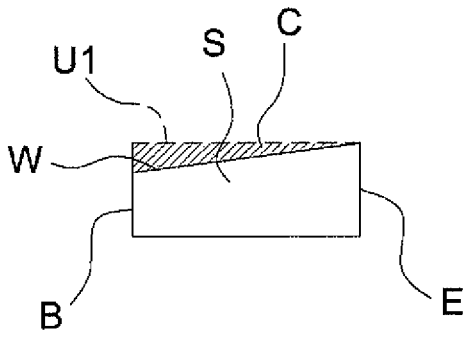

Since the section at the front end E of the engaging protrusion 221' is smaller than the section at the front end E in the first embodiment due to the cut portion C, the twisted contact surface S near the angular point of the front end E may form an interval 220*c*2' that is greater than the interval 120*c* of about 0.4 mm to about 0.6 mm with the twisted hole 181. Also, as getting closer to the base B from the front end E of the engaging protrusion 221', the section of the cut portion C may be gradually reduced. Accordingly, the interval between the twisted contact surface S and the twisted hole 181 around the angular point may be gradually reduced, and the length of the line contact portion may be gradually increased. In this case, as shown in FIG. 14, the interval 120*c* with the twisted hole 181 at the twisted contact surface S may be uniformly maintained. Thus, the contact surface S between the engaging protrusion 221 and the twisted hole 181, as shown in FIG. 17C, may become a trapezoidal shape, and the length of the ling contact portion may be gradually increased as getting closer to the base part from the front end part, forming a contact expansion region dc.

The twisted contact surface (S of FIG. 17C) of the engaging protrusion 221' according to the modified example of the second embodiment may have an area in which the area of the twisted contact surface (S of FIG. 17A) of the engaging protrusion 121 according to the first embodiment is subtracted by an area excluded by the cut portion C. The reference numeral U1 of FIG. 17C denotes a boundary of the twisted contact surface (S of FIG. 17A) at one side when a uniform section is formed along the protrusion direction (first embodiment) while maintaining the interval 120*c* of about 0.4 mm to about 0.6 mm with the twisted hole 181.

Thus, as the portion C of the engaging protrusion 121' is cut to form the contact expansion region dc, the engaging protrusion 221' may have a smaller section 221E' at the front end E thereof to be more smoothly and quietly inserted when the driving assembly of the photosensitive drum is mounted into the triangular twisted hole 181 of the image forming apparatus. Also, since the engaging protrusion 221' has a larger section 221B' at the base B thereof, when the engaging protrusion 221' is sufficiently inserted into the twisted hole 181, a rotary driving force can be transferred through a wider contact surface, thereby ensuring a stable image quality without sliding due to high friction.

Figure 16:
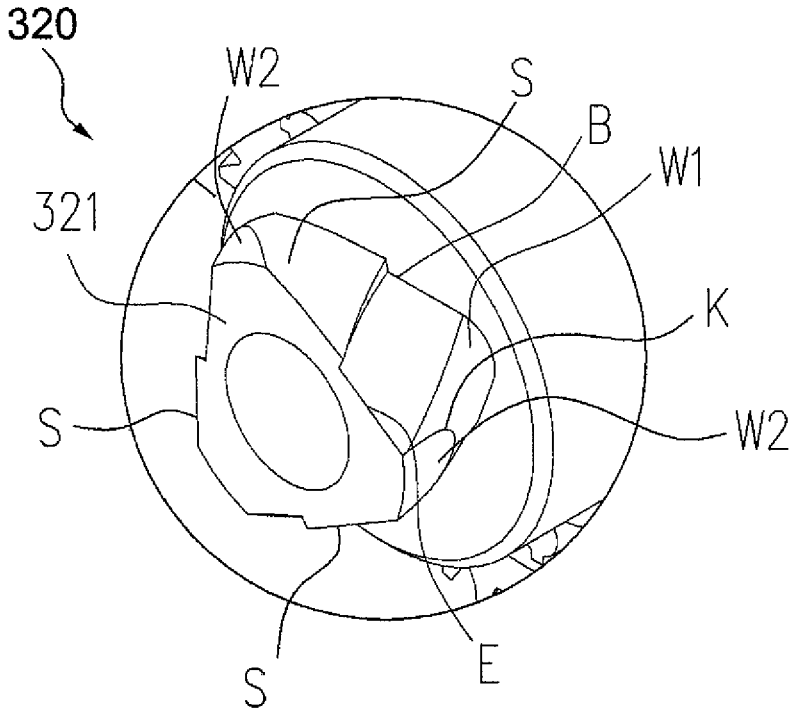
FIG. 16 is a perspective view illustrating a driving assembly according to a third embodiment of the present invention.

Hereinafter, a third embodiment of the present invention will be described in detail with reference to FIG. 16. However, configurations of the third embodiment similar to those of the previous embodiments will be indicated as the same or similar reference numerals, and detailed descriptions thereof will be omitted to clarify the essential points of the third embodiment.

A photosensitive drum assembly 320 according to the third embodiment of the present invention may have an engaging protrusion 321 with a smaller twisted contact surface S at the front end thereof by cutting a front end portion of the engaging protrusion 321 to form an inclination surface W2.

Similarly to the engaging protrusion 121 of the first embodiment, the driving assembly according to the third embodiment of the present invention may have inclination surfaces W1 and W2 that are formed by removing a portion of the twisted contact surface S such that the sectional area of the engaging protrusion 321 increases as getting closer to the base B from the front end E. A boundary at which the inclination degree of the inclination surfaces W1 and W2 is changed may be defined as an inflection line K. Thus, since the inclination degree of the inclination surfaces W1 and W2 rapidly increases at the front end portion thereof; an interference generated when the engaging protrusion 321 is inserted into the triangular twisted hole 181 can be more completely removed.

Figure 17D:
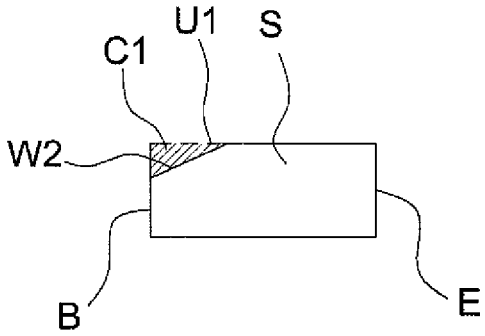
Figure 17E:
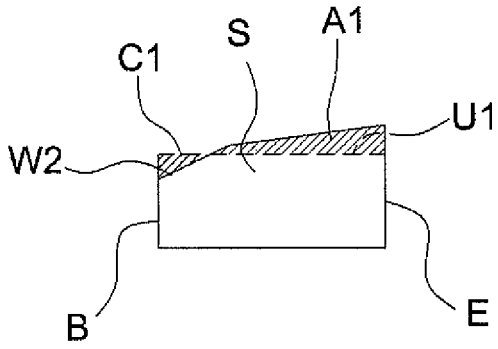

The inclination surface W2 cutting the front end portion according to the third embodiment can be applied to the first and second embodiments and the modified example of the second embodiment throughout. As shown in FIG. 17D, regarding the engaging protrusion 121 of the first embodiment forming a twisted contact surface S of a rectangular shape, the inclination surface W2 may be formed by cutting only the front end portion thereof (C1). Alternatively, regarding the engaging protrusion 221 of the second embodiment forming the twisted contact surface S of a trapezoidal shape, the inclination surface W2 may be formed by cutting the front end portion thereof.

Although not shown, due to the inclination surface W2 in which only the front end portion of the engaging protrusion 221' is cut, a line contact portion that contacts the twisted hole 181 may not exist. Thus, an interference generated when the engaging protrusion 321 is inserted into the triangular twisted hole 181 can be more surely removed.

Hereinafter, a fourth embodiment of the present invention will be described in detail with reference to FIGS. 18A and 18B. However, configurations of the fourth embodiment similar to those of the previous embodiments will be indicated as the same or similar reference numerals, and detailed descriptions thereof will be omitted to clarify the essential points of the fourth embodiment.

Figure 18A:
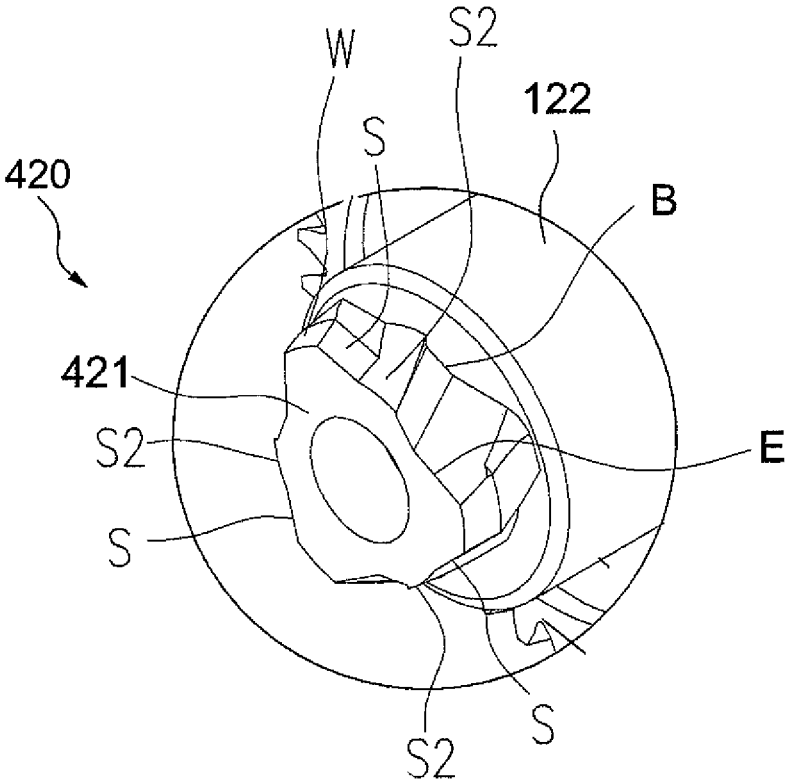
FIG. 18A is a perspective view illustrating a driving assembly according to a fourth embodiment of the present invention.
Figure 18B:
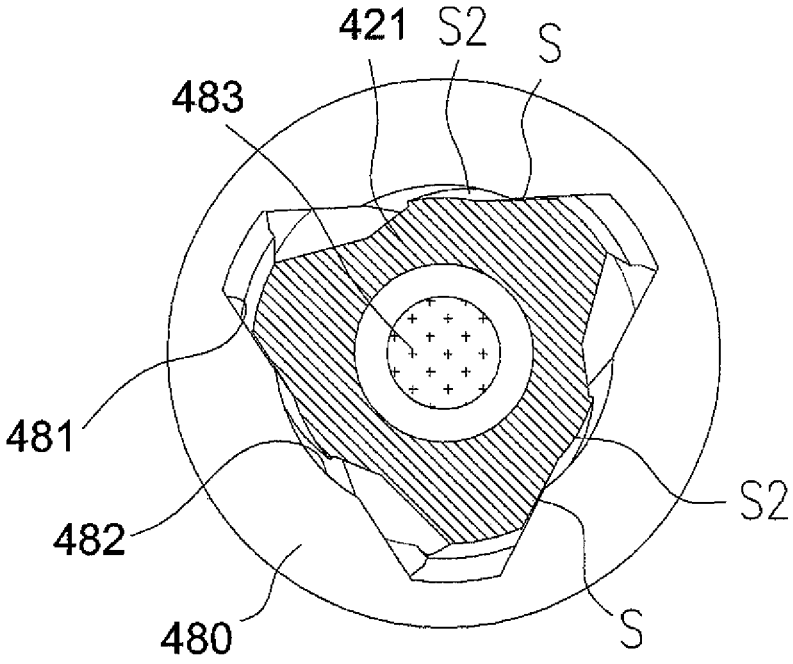
FIG. 18B is a cross-sectional view illustrating an engagement of an engaging protrusion and a triangular twisted hole of FIG. 18A.

Referring to FIGS. 18A and 18B, compared to the engaging protrusion 121 of the first embodiment, a driving assembly 420 according to the fourth embodiment may have an engaging protrusion 421 that has a twisted contact surface S2 engaging with a circular section 482 combined with a triangular section 481 in a straight-line groove form in addition to a twisted contact surface S engaging with the triangular section 481 so as to be applied to a twisted hole 380 of an image forming apparatus, which is twisted along a depth direction in a section shape in which the triangular section and the circular section are combined.

As shown in FIG. 18B which illustrates an engaging state of the engaging protrusion 421 at a base portion, the twisted contact surface S formed on the side surface of the engaging protrusion 421 may contact the triangular section 481 of the twisted hole to form a line contact portion. The other twisted contact surface S2 of the engaging protrusion 421 may contact the circular section 482 of the twisted hole to form a line contact portion. Also, at the front end portion of the engaging protrusion 421, the twisted contact surfaces S and S2 may contact the triangular section 481 and the circular section 482 to form line contact portions.

Here, the twisted contact surface S of the engaging protrusion 421 contacting the triangular section 481 may be formed by the first embodiment, the second embodiment, the modified example of the second embodiment, and a combination thereof.

Thus, as the twisted contact surface S2 that is also engaged with the circular section 482 is together formed in the twisted hole 181 of the image forming apparatus, the twist hole 480 of the image forming apparatus and the engaging protrusion 421 of the driving assembly 420 can become in surface contact with each other by a higher frictional force. Accordingly, the occurrence of sliding can be inhibited therebetween, and a rotary driving force delivered from the image forming apparatus can be exactly received without a loss.

Although it has been exemplified that the twisted contact surfaces S and S2 of the engaging protrusion 421 are in line contact with the triangular section 481 and the circular section 482 of the twisted hole to form the ling contact portions, the line contact portions may be formed on only one of the triangular section 481 and the circular section 482, and a point contact may be formed on the other. The reference numeral 483 unexplained denotes a protrusion of the image forming apparatus, which is inserted into a central hole of the engaging protrusion 221.

Hereinafter, a fifth embodiment of the present invention will be described in detail with reference to FIG. 19. However, configurations of the fifth embodiment similar to those of the previous embodiments will be indicated as the same or similar reference numerals, and detailed descriptions thereof will be omitted to clarify the essential points of the fifth embodiment.

Figure 19:
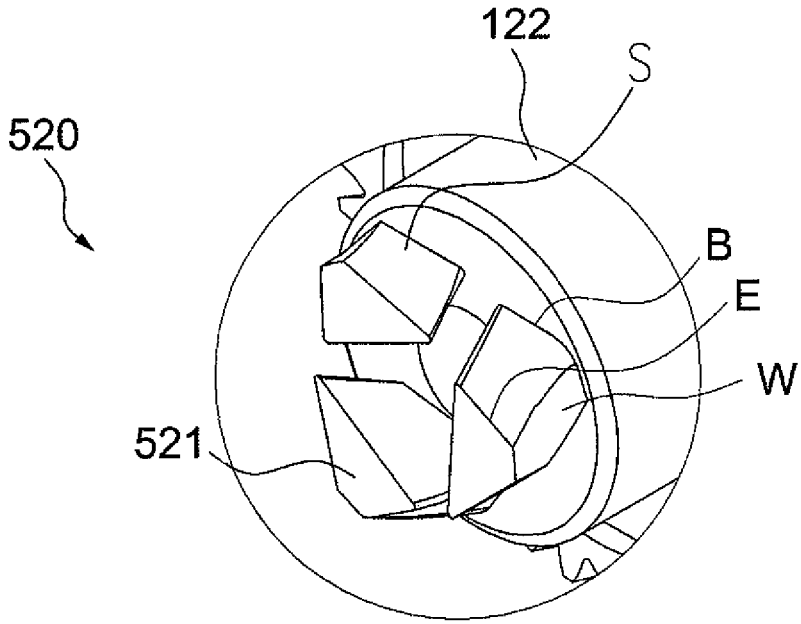
FIG. 19 is a perspective view illustrating a driving assembly according to a fifth embodiment of the present invention.

Referring to FIG. 19, instead of the engaging protrusion of one pillar shape formed by the first embodiment, the second embodiment, the modified example of the second embodiment, the third embodiment, and a combination thereof, a driving assembly according to the fifth embodiment of the present invention may have an engaging protrusion including three division protrusions 521 with a twisted contact surface S forming a line contact portion, respectively. The twisted contact surface S may be formed on the side surface of the engaging protrusion 521 including the three division protrusions, respectively. The twisted surface S may contact a twisted hole 181 to form a contact surface, stably transferring a rotary driving force without a mutual sliding due to high friction.

Figure 20:
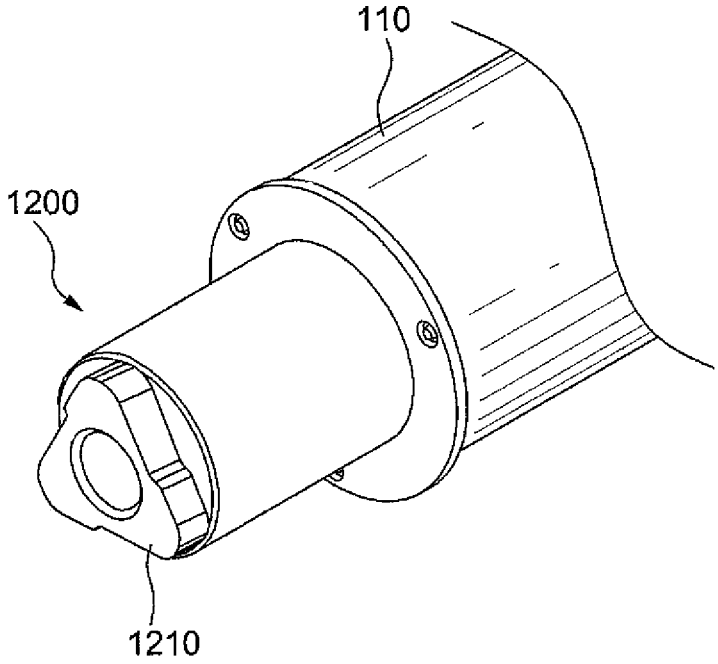
FIG. 20 is a perspective view illustrating a driving assembly according to a sixth embodiment of the present invention.

Hereinafter, a sixth embodiment of the present invention will be described in detail with reference to FIG. 20. A driving assembly 1200 according the sixth embodiment of the present invention may have an engaging protrusion 1210 fixed at one side of a photosensitive drum 110. The engaging protrusion 1210 may be formed according to the first embodiment, the second embodiment, the modified example of the second embodiment, the third embodiment, the fourth embodiment, the fifth embodiment, and a combination thereof. Here, a support body 1220 fixedly located on the photosensitive drum 110 may be longitudinally formed without a gear part.

Figure 21:
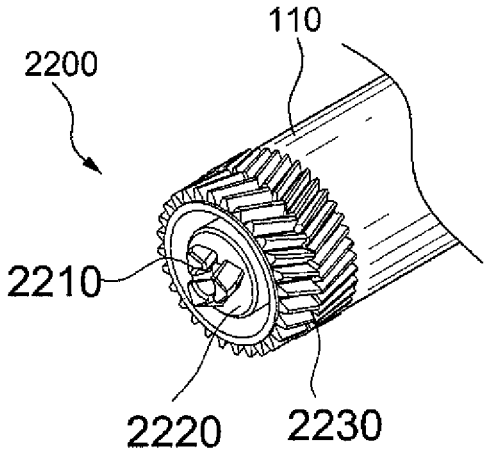
FIG. 21 is a perspective view illustrating a driving assembly according to a seventh embodiment of the present invention.

Hereinafter, a seventh embodiment of the present invention will be described in detail with reference to FIG. 21. A driving assembly 2200 according to the seventh embodiment of the present invention may have an engaging protrusion 2210 fixed at one side of a photosensitive drum 110. The engaging protrusion 2210 may be formed according to the first embodiment, the second embodiment, the modified example of the second embodiment, the third embodiment, the fourth embodiment, the fifth embodiment, and a combination thereof. Here, a support body 2220 fixedly located on the photosensitive drum 110 may be received in a gear part.

Figure 2:
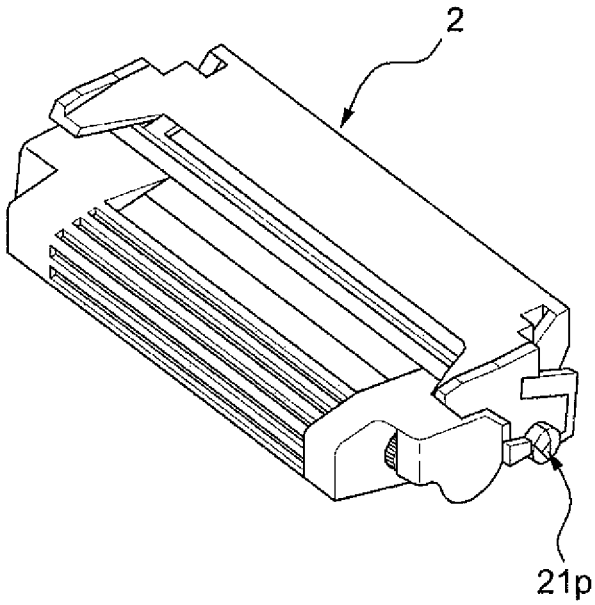
FIG. 2 is a perspective view illustrating the exterior of a cartridge of FIG. 1.
Figure 3:
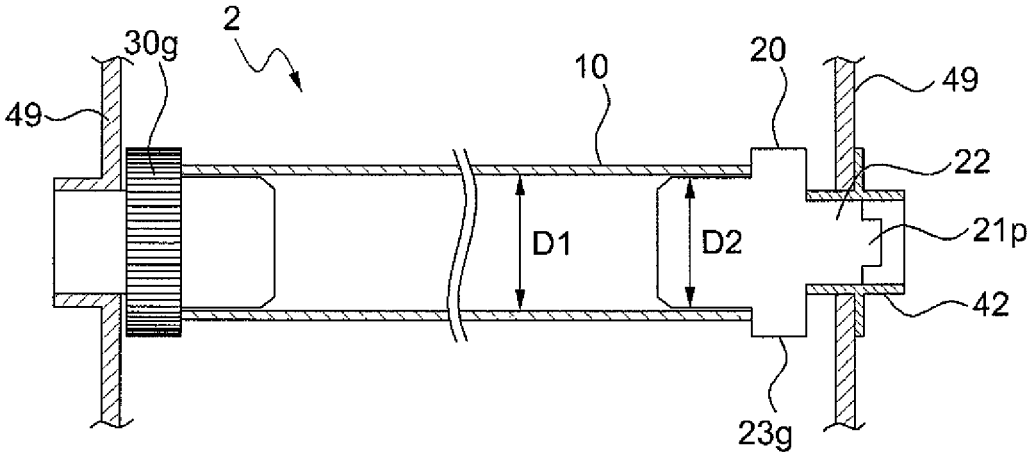
FIG. 3 is a cross-sectional view illustrating a photosensitive drum of the cartridge of FIG. 1 and a peripheral configuration thereof.
Figure 4:
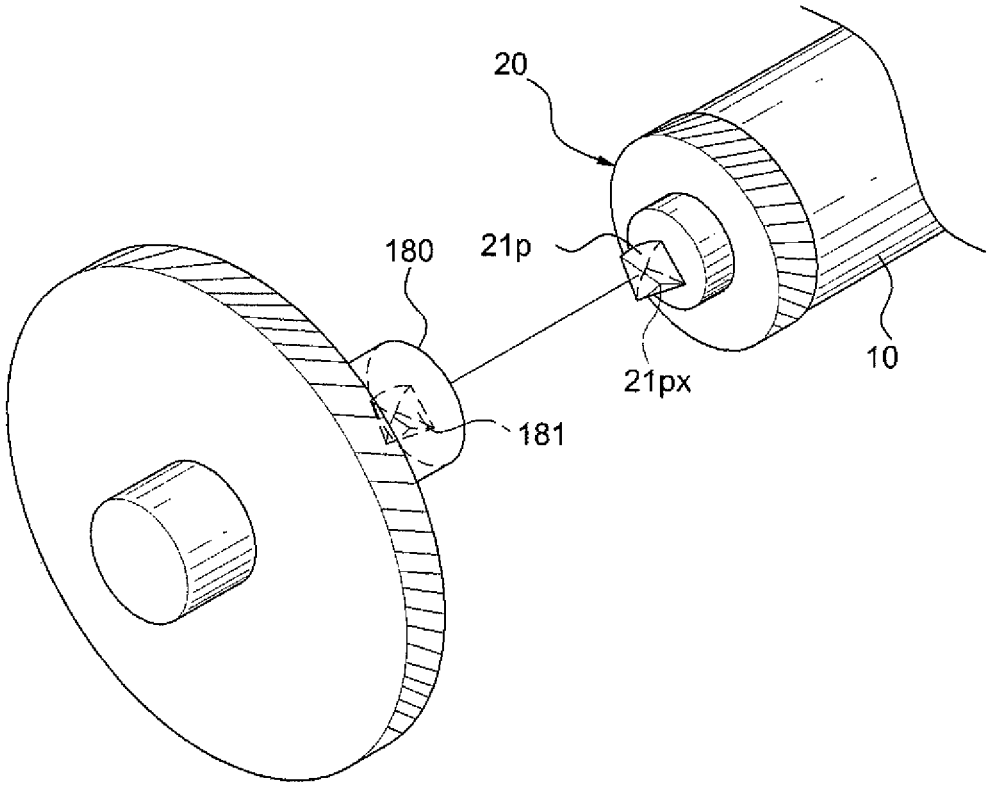
FIGS. 4 and 5 are perspective views illustrating a rotation driving force transmission structure of a typical image forming apparatus.
Figure 5:
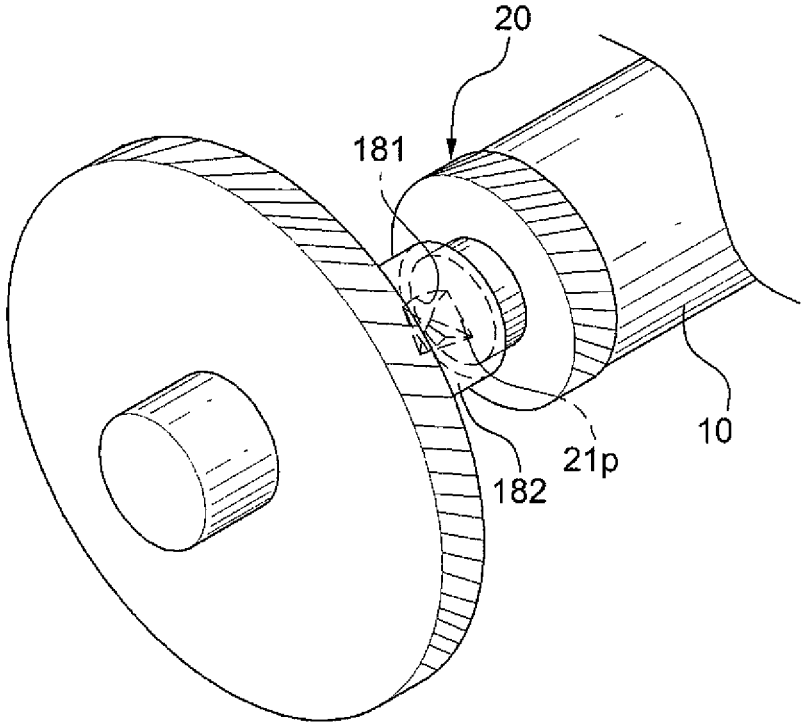

The photosensitive drum assembly 100 including the driving assemblies 120, 220, 320 and 420 may be applied to the cartridge 2 shown in FIG. 2. The cartridge 2 including the photosensitive drum assembly 100 may be detachably disposed in the image forming apparatus shown in FIG. 1.

Although the driving assembly for the photosensitive drum, the photosensitive drum assembly, the process cartridge, and the image forming apparatus have been described according to specific embodiments, these embodiments are merely examples. Therefore, the present invention will not be limited to these embodiments, and should be construed as having the widest sense according to the fundamental spirit set forth in this disclosure. Also, those skilled in the art can implement patterns having undescribed shapes by combining or replacing the disclosed embodiments, but these patterns will not deviate from the scope of the present invention. Besides, those skilled in the art can easily change or modify the embodiments set forth in this disclosure, and it will be apparent that these changes or modifications fall within the scope of the present invention.

Figure 6:
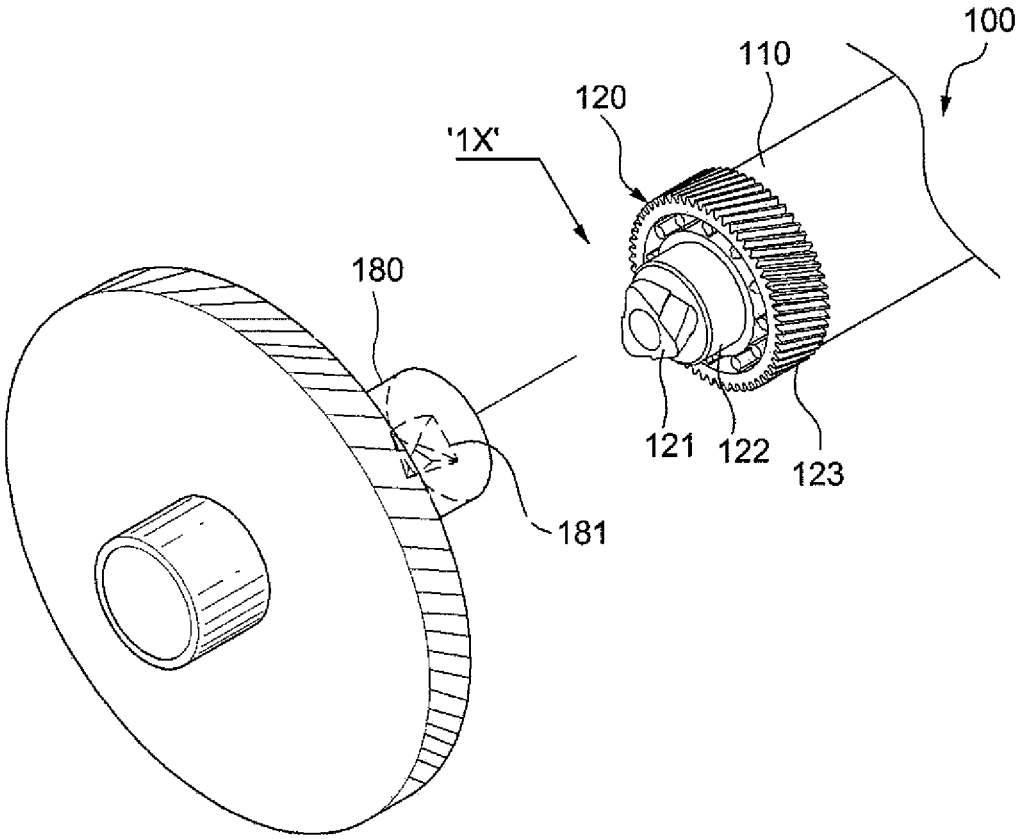
FIG. 6 is a perspective view illustrating a rotation driving force transmission structure of an image forming apparatus according to a first embodiment of the present invention.

Therefore, the driving assemblies pertaining to the scope of the present invention will not be limited to the shape in which a helical gear 123 is mounted as shown in FIG. 6. Rather, as shown in FIG. 19, a configuration in which the engaging protrusion 1210 is inserted into the twisted hole 18 without a gear part will also fall within the scope of the present invention.

In a photosensitive drum driving assembly, a photosensitive drum assembly, a process cartridge, and an image forming apparatus according to an embodiment of the present invention, since a driving force from a main body of the image forming apparatus rotates a photosensitive drum by a frictional surface contact with a twisted contact surface of an engaging protrusion by allowing a protrusion of the driving assembly to be in surface contact with a twisted hole of a drive shaft of the image forming apparatus, the abrasion and damage of the engaging protrusion can be prevented, thereby achieving high durability and high rotation load capacity.

Also, the twisted contact surface of the engaging protrusion and the twisted surface of the twisted hole are in surface contact with each other, and the engaging protrusion is formed such that the section at a base portion is larger than that at a front end portion. Also, since a rotary driving force is transferred by a high frictional force without a sliding due to the surface contact between the engaging protrusion and the twisted hole, the image quality of the image forming apparatus can be stably maintained in spite of long-time use.

Also, since the section at the base portion near the angular point corresponding to the angular point of the twisted hole is more protrusively formed outwardly from the rotation center than the section at the front end portion while not reducing the section at the front end portion of the engaging protrusion compared to a related art to form a contact expansion region in which a line contact portion of the twisted contact surface is gradually lengthened, the sectional area of the front end portion can be uniform and can more widely contact the surface of the twisted hole at the base portion, thereby stably transferring a rotary driving force without sliding due to high friction and also ensuring a longer durability lifespan.

Also, since an inclination surface is formed along the protrusion direction of the engaging protrusion by removing a portion of the twisted contact surface of the engaging protrusion, the driving assembly of the photosensitive drum can smoothly inserted into the triangular twisted hole of the main body of the image forming apparatus without noise or shock, thereby allowing the photosensitive drum to be more quietly mounted in the image forming apparatus and overcoming reduction of the durability.

Furthermore, the present invention can rotate in a type in which the twist section is in line contact with the hole only at the base portion of the engaging protrusion according to the type of the inclination surface, and the engaging protrusion can be easily inserted into the twisted hole according to the type of the inclination surface.

In addition, since the section perpendicular to the protrusion direction of the engaging protrusion forms a line contact portion with the twisted hole, even when a corner of the engaging protrusion is damaged, a rotary driving force can be transferred at three points. Accordingly, even when considering the damage, the image quality of the image forming apparatus can be more surely maintained.

Here, the section perpendicular to the protrusion direction of the engaging protrusion may have various shapes such as hexagonal.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Having described the invention, the following is claimed:

1. A driving assembly for a photosensitive drum, connected to a drive shaft having a triangular twisted hole to transfer a rotary driving force from an image forming apparatus, the driving assembly comprising:

a supporting body combined at one side of the photosensitive drum; and an engaging protrusion twistedly protruding from the supporting body and inserted into the twisted hole, wherein the engaging protrusion having three or more line contact portions on its cross-section perpendicular to the protrusion direction, the line contact portions being in line contact with a twisted surface of the twisted hole, wherein at least one portion of a surface formed by continuously joining the line contact portions along the protrusion direction is a twisted contact surface that is in surface contact with the twisted surface of the twisted hole to receive the rotary driving force transferred by the drive shaft, and wherein the twisted contact surface includes a contact expansion region in which a length of the line contact portion gradually increases as getting closer to a base portion from a front end portion.

2. The driving assembly of claim 1, wherein the engaging protrusion is formed to have a uniform section from a front end portion to a base portion thereof.

3. The driving assembly of claim 1, wherein the engaging protrusion has an inclination surface formed by cutting a front end portion thereof such that the twisted contact surface becomes smaller at the front end portion of the engaging protrusion.

4. The driving assembly of claim l, wherein the engaging protrusion is averagely spaced from the twisted hole by about 0.4 mm to about 0.6 mm at the front end portion thereof.

5. The driving assembly of claim l, wherein the engaging protrusion forms the contact expansion region such that a section near an angular point corresponding to an angular point of the twisted hole protrudes more outwardly from a rotation center at the base portion than a section at the front end portion.

6. The driving assembly of claim 1, wherein the line contact portion is not formed at a front end portion of the engaging protrusion.

7. The driving assembly of claim 1, wherein the engaging protrusion has a protrusion portion protruding in a direction perpendicular to the protrusion direction, and the twisted contact surface is located at the protrusion portion.

8. The driving assembly of claim 1, wherein the twisted hole is formed in a twisted type along a depth direction such that a triangular section and a circular section are combined, and the line contact portion of the engaging protrusion in line contact with the twisted surface of the twisted hole comprises a region that contacts the circular section.

9. The driving assembly of claim 1, wherein the engaging protrusion twistedly protrudes from the supporting body so as to have a shape divided into three protrusions comprising the line contact portion, respectively.

10. A driving assembly for a photosensitive drum, connected to a drive shaft having a triangular twisted hole to transfer a rotary driving force from an image forming apparatus, the driving assembly comprising:

a supporting body combined at one side of the photosensitive drum; and an engaging protrusion twistedly protruding from the supporting body and inserted into the twisted hole, wherein the engaging protrusion having three or more line contact portions on its cross-section perpendicular to the protrusion direction, the line contact portions being in line contact with a twisted surface of the twisted hole, wherein at least one portion of a surface formed by continuously joining the line contact portions along the protrusion direction is a twisted contact surface that is in surface contact with the twisted surface of the twisted hole to receive the rotary driving force transferred by the drive shaft, and wherein the engaging protrusion has an inclination surface formed by cutting a front end portion thereof such that the twisted contact surface becomes smaller at the front end portion of the engaging protrusion.

11. The driving assembly of claim 10, wherein the inclination surface has an inflection portion at which an inclination degree changes according to the protrusion direction of the engaging protrusion.

12. A photosensitive drum assembly comprising:

a photosensitive drum; and a driving assembly coupled to one end portion of the photosensitive drum and receiving a rotary driving force provided from a driving motor mounted in a main body of an image forming apparatus, said driving assembly connected to a drive shaft having a triangular twisted hole to transfer the rotary driving force, wherein the driving assembly comprises:

a supporting body combined at one side of the photosensitive drum; and an engaging protrusion twistedly protruding from the supporting body and inserted into the twisted hole, wherein the engaging protrusion having three or more line contact portions on its cross-section perpendicular to the protrusion direction, the line contact portions being in line contact with a twisted surface of the twisted hole, wherein at least one portion of a surface formed by continuously joining the line contact portions along the protrusion direction is a twisted contact surface that is in surface contact with the twisted surface of the twisted hole to receive the rotary driving force transferred by the drive shaft, and wherein the twisted contact surface includes a contact expansion region in which a length of the line contact portion gradually increases as getting closer to a base portion from a front end portion.

13. A process cartridge detachably coupled to a main body of an image forming apparatus, comprising:

a photosensitive drum assembly printing an image on a recording material, wherein said photosensitive drum assembly comprises:

a photosensitive drum; and a driving assembly coupled to one end portion of the photosensitive drum and receiving a rotary driving force provided from a driving motor mounted in the main body of the image forming apparatus, said driving assembly connected to a drive shaft having a triangular twisted hole to transfer the rotary driving force, wherein the driving assembly comprises:

a supporting body combined at one side of the photosensitive drum; and an engaging protrusion twistedly protruding from the supporting body and inserted into the twisted hole, wherein the engaging protrusion having three or more line contact portions on its cross-section perpendicular to the protrusion direction, the line contact portions being in line contact with a twisted surface of the twisted hole, wherein at least one portion of a surface formed by continuously joining the line contact portions along the protrusion direction is a twisted contact surface that is in surface contact with the twisted surface of the twisted hole to receive the rotary driving force transferred by the drive shaft, and wherein the twisted contact surface includes a contact expansion region in which a length of the line contact portion gradually increases as getting closer to a base portion from a front end portion; and a toner storage supplying a toner to the photosensitive drum.

14. An image forming apparatus comprising:

a main body;

a driving motor mounted in the main body;

a drive shaft transferring a driving force provided from the driving motor and having a triangular twisted hole; and a process cartridge detachably coupled to the main body and receiving the driving force from the drive shaft, wherein said process cartridge comprises:

a photosensitive drum assembly printing an image on a recording material, wherein said photosensitive drum assembly comprises:

a photosensitive drum; and a driving assembly coupled to one end portion of the photosensitive drum and receiving the driving force provided from the driving motor, said driving assembly connected to the drive shaft to transfer the driving force, wherein the driving assembly comprises:

a supporting body combined at one side of the photosensitive drum; and an engaging protrusion twistedly protruding from the supporting body and inserted into the twisted hole, wherein the engaging protrusion having three or more line contact portions on its cross-section perpendicular to the protrusion direction, the line contact portions being in line contact with a twisted surface of the twisted hole, wherein at least one portion of a surface formed by continuously joining the line contact portions along the protrusion direction is a twisted contact surface that is in surface contact with the twisted surface of the twisted hole to receive the driving force transferred by the drive shaft, and wherein the twisted contact surface includes a contact expansion region in which a length of the line contact portion gradually increases as getting closer to a base portion from a front end portion; and a toner storage supplying a toner to the photosensitive drum.

* * * * *